US006494291B2

(12) United States Patent
Ono

(10) Patent No.: US 6,494,291 B2
(45) Date of Patent: Dec. 17, 2002

(54) FOLDABLE SCAFFOLD DEVICE

(76) Inventor: Tatsuo Ono, 1-chome, 10-ban, 1-go, Kakigara-cho, Nihonbashi, Chuo-ku, Tokyo (JP)

( * ) Notice: Subject to any disclaimer, the term of this patent is extended or adjusted under 35 U.S.C. 154(b) by 0 days.

(21) Appl. No.: 09/844,641

(22) Filed: Apr. 27, 2001

(65) Prior Publication Data

US 2002/0157900 A1 Oct. 31, 2002

(51) Int. Cl.[7] ..... E04G 3/00
(52) U.S. Cl. ..... 182/82; 182/150
(58) Field of Search ..... 182/150, 82; 248/228.1, 248/228.5, 231.61

(56) References Cited

U.S. PATENT DOCUMENTS

| | | | | | |
|---|---|---|---|---|---|
| 1,795,808 | A | * | 3/1931 | Thompson | 248/228.5 |
| 2,049,893 | A | * | 8/1936 | Chicoine | 248/228.5 X |
| 2,854,292 | A | * | 9/1958 | Schaeffer | 182/150 X |
| 2,916,244 | A | * | 12/1959 | Renfroe | 248/228.2 |
| 4,029,173 | A | * | 6/1977 | Wakabayashi | 182/150 |
| 5,863,020 | A | * | 1/1999 | Olson et al. | 248/228.5 X |

FOREIGN PATENT DOCUMENTS

| | | | | |
|---|---|---|---|---|
| JP | 338145 | A1 | * 10/1989 | 182/150 |

* cited by examiner

*Primary Examiner*—Daniel P. Stodola
*Assistant Examiner*—Hugh B. Thompson
(74) *Attorney, Agent, or Firm*—McGlew and Tuttle, P.C.

(57) ABSTRACT

An erectable and transportable scaffold device adapted to be engaged on and supported on a support beam comprises front and rear frame structures which are pivotally interconnected by means of parallel side braces which are connected between the frame structures. A scaffold plate is pivotally connected to the lower ends of each of the front and rear frames. And the front frame is pivotal outwardly from the rear structure to form a cage within the front and rear structures and the side braces having a floor formed by a scaffold plate. The plate has upright bottom edges which fit flush against the insides of an angle member forming the sides of the front fra me structure so that it facilitates the holding of the structure in an erected cage forming position. A flexible or foldable member such as a chain or so is connected between the upper ends of each side of the front structure to the upper ends of each side of the rear structure. The rear structure also carries a rigid holding bracket rigidly connected to a bolt having a front pawl and a rear pawl which is slidable therealong and which may be engaged against a support structure such as an I-beam by threading a wing nut onto the bolt behind said year pawl to lock it in position.

10 Claims, 7 Drawing Sheets

FOLDABLE SCAFFOLD DEVICE

BACKGROUND OF THE INVENTION

1. Field of the Invention

This invention relates in general to the construction of scaffolding device and in particular to an improved scaffold which includes front and rear structures which are pivotally interconnected by parallel side braces so that the front structure may be suspended by means of a flexible element outwardly from the rear structure to form a cage.

And further the rear structure of the scaffolding device is fixed and settable safely, reliably and firmly to a support structure such as an I-beam in a place to construct.

2. Description of the Prior Art

The invention relates to the construction of a foldable scaffold device which is particularly useful in the erection of buildings or the construction of ships, etc. The foldable scaffold device of prior art is well known as shown in The U.S. Pat. No. 4,029,173.

And known scaffold device is secured in position on a supporting structure such as a beam through a fitting means. Said fitting means consists of a fitting member connected to a rear structure, a bolt connected to said fitting means, pawl being slidably supported on said bolt and a nut being threaded on said bolt backwardly behind said pawl. In an erected position of said scaffold device, said fitting member directly contacts with a front edge of H-sectional structure and said pawl contacts with a rear edge of a H-sectional structure and thereafter said pawl is tied from backward through said nut. Said fitting member of said scaffold device is fitted up to a hinge being freely rotatable to any directions and unstable. And then said scaffold device is unstably adapted and supported on a support beam with unsteady states.

Disadvantage of the known structures is that they are inclined in case of attaching a scaffold device by a strong threading force of said nut, because rear structures are pulled backwardly by a reaction of said threading. And the scaffold device is rotated to a direction such as pivoting a contact point with a H-sectional structure, and therefore it will be feared that work man in a scaffold floor is exposed himself to danger, for example, as the rear frame structure may be yielded and broken by a weight of him in case when he gets on an inclined scaffold cage, or as the scaffold may swing around the hinge.

SUMMARY OF THE INVENTION

In accordance with the present invention there is provided an erectable and transportable scaffold cage adapted to be engaged on and supported on a support beam. Said scaffold cage comprises front and rear frame structures which are pivotally interconnected by means of parallel side braces which are connected between the frame structures. A scaffold plate is pivotally connected to the lower ends of each of the front and rear frames. And the front frame is pivotally outwardly from the rear structure to form a cage within the front and rear structures and the side braces having a floor formed by a scaffold plate. The plate has upright bottom edges, which fit flush against the insides of an angle member forming the sides of the front frame structure so that it facilitates the holding of the structure in an erected cage forming position. A flexible member such as a chain is connected between the upper ends of each side of the front structure to the upper ends of each side of the rear structure.

The rear structure carries a holding bracket connected to a bolt having a front pawl and a rear pawl, which is slidable therealong and which may be engaged against a support structure such as an I-beam by threading a wing nut onto the bolt behind said rear pawl to lock it in position.

And further the rear structure also carries a holding bracket consisting of an unity and being rigidly fixed and connected to a bolt having a front pawl and a rear pawl which is slidable therealong and which may be engaged against a support structure such as an I-beam by threading a wing nut onto the bolt behind the rear pawl to lock it in position.

Accordingly, it is an object of the invention to provide an erectable and transportable scaffold cage, which is not inclined even when it may be engaged with a strong force against a support structure such as an I-beam by threading a wing nut.

A further object of the invention is to provide an erectable and transportable scaffold cage, which is fixed and settable safely, reliably and firmly to a support structure without unsteady states.

DETAILED EXPLANATION OF THE INVENTION

Figure 1:
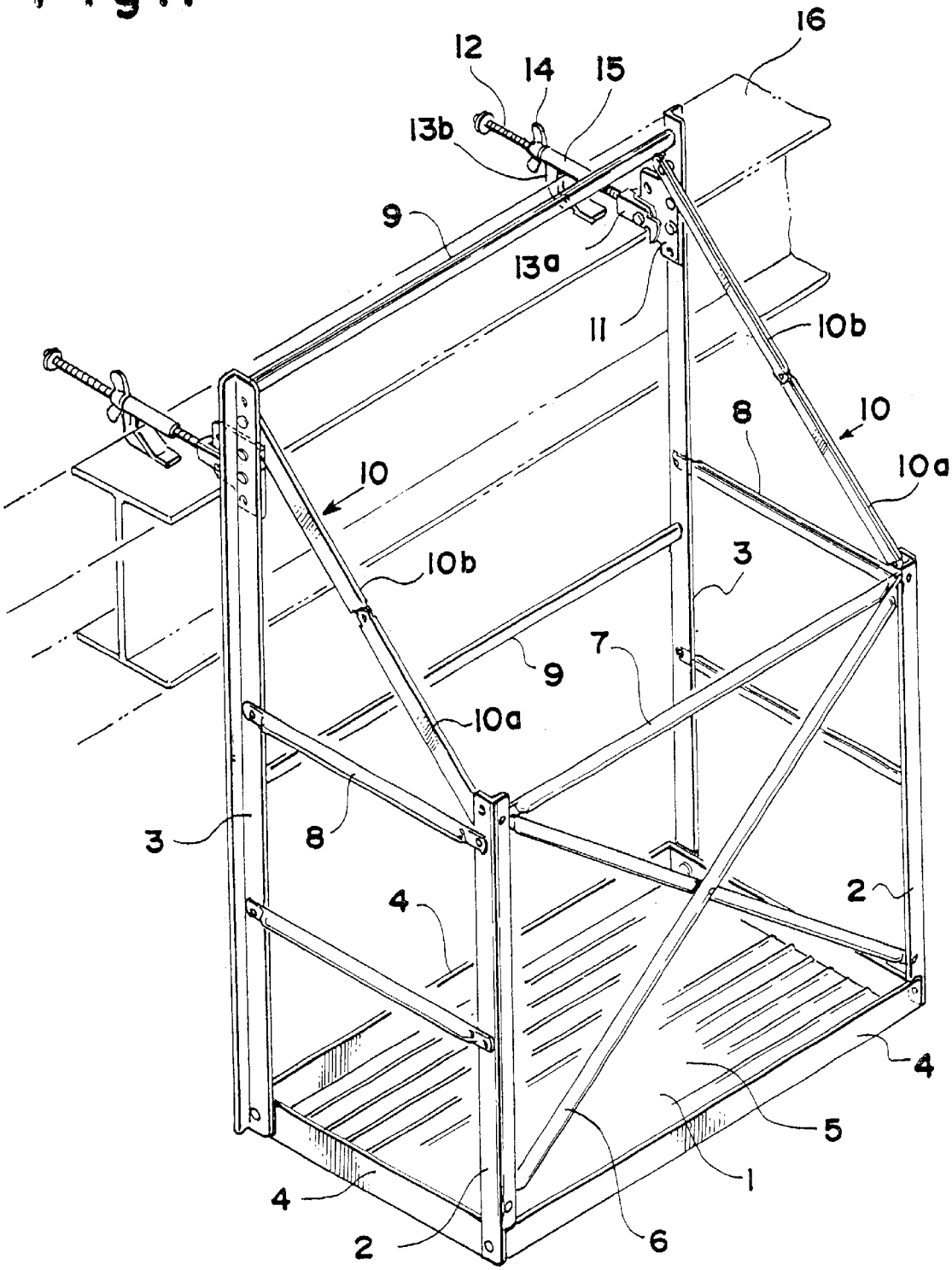
FIG. 1 is a perspective view of a scaffold device according to an embodiment of the present invention.
Figure 5:
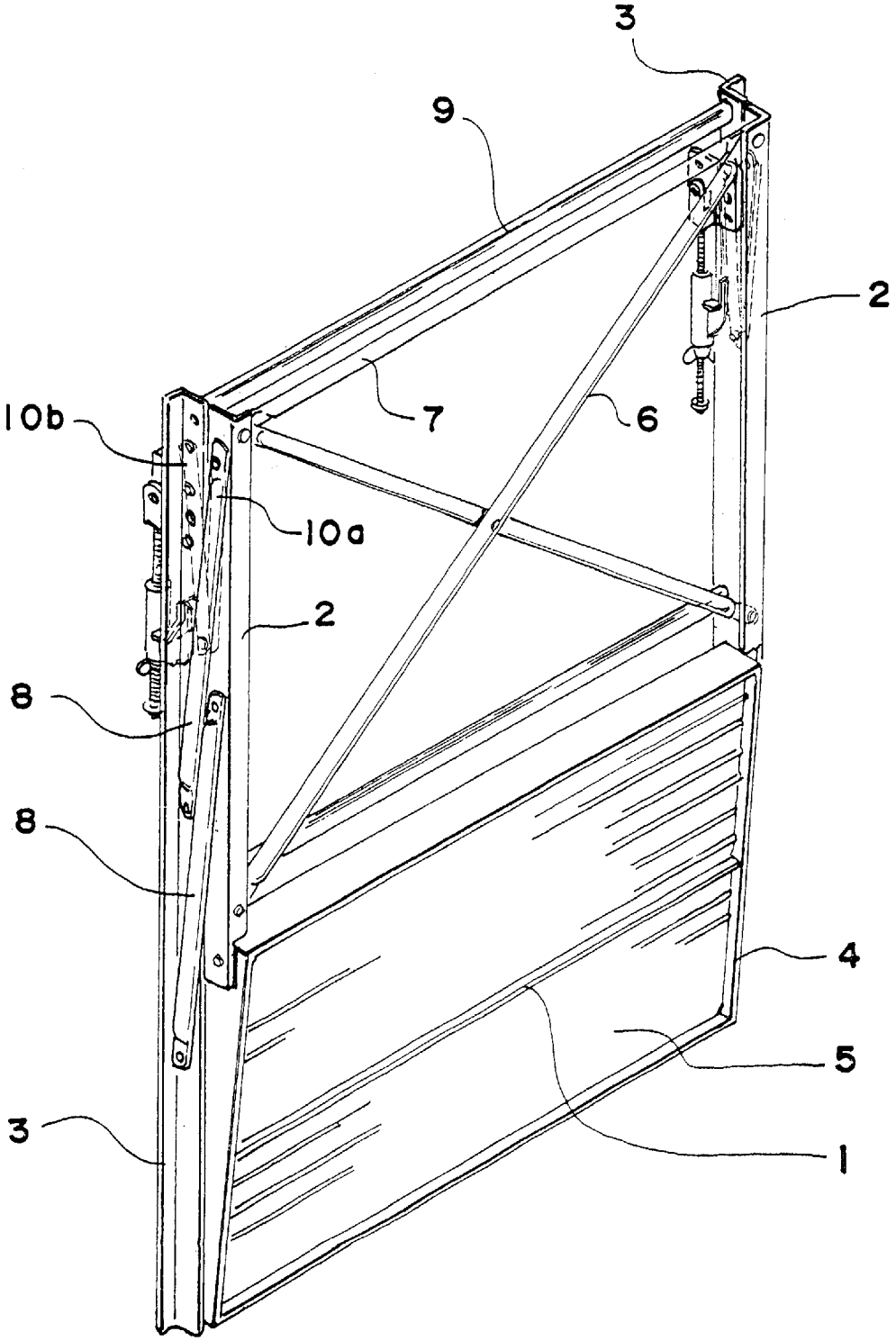
FIG. 5 is a folded view of a scaffold device according to an embodiment of the present invention.
Figure 6:
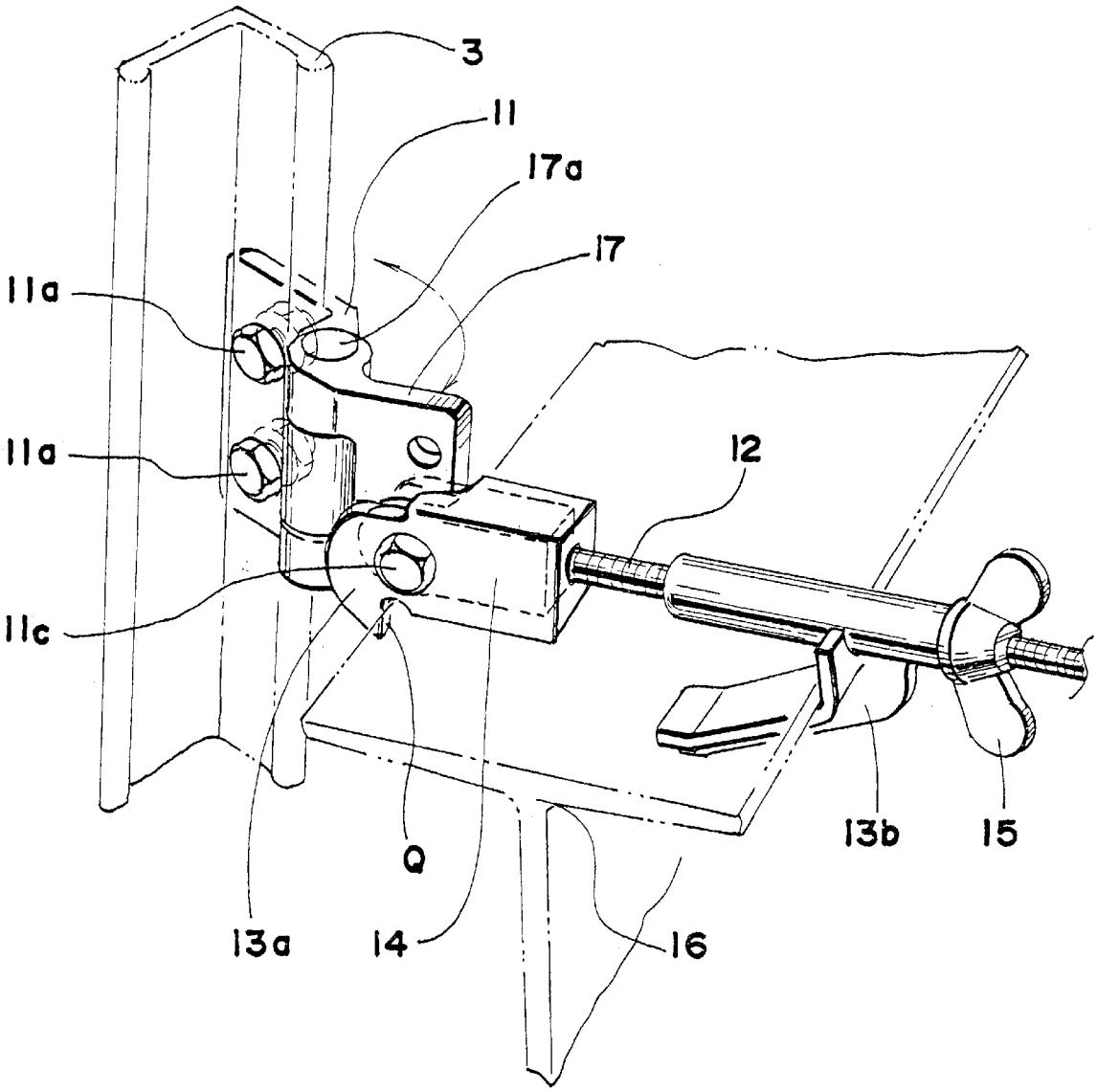
FIG. 6 is aprspective view of a scaffold device according to another embodiment of the present invention.
Figure 7:
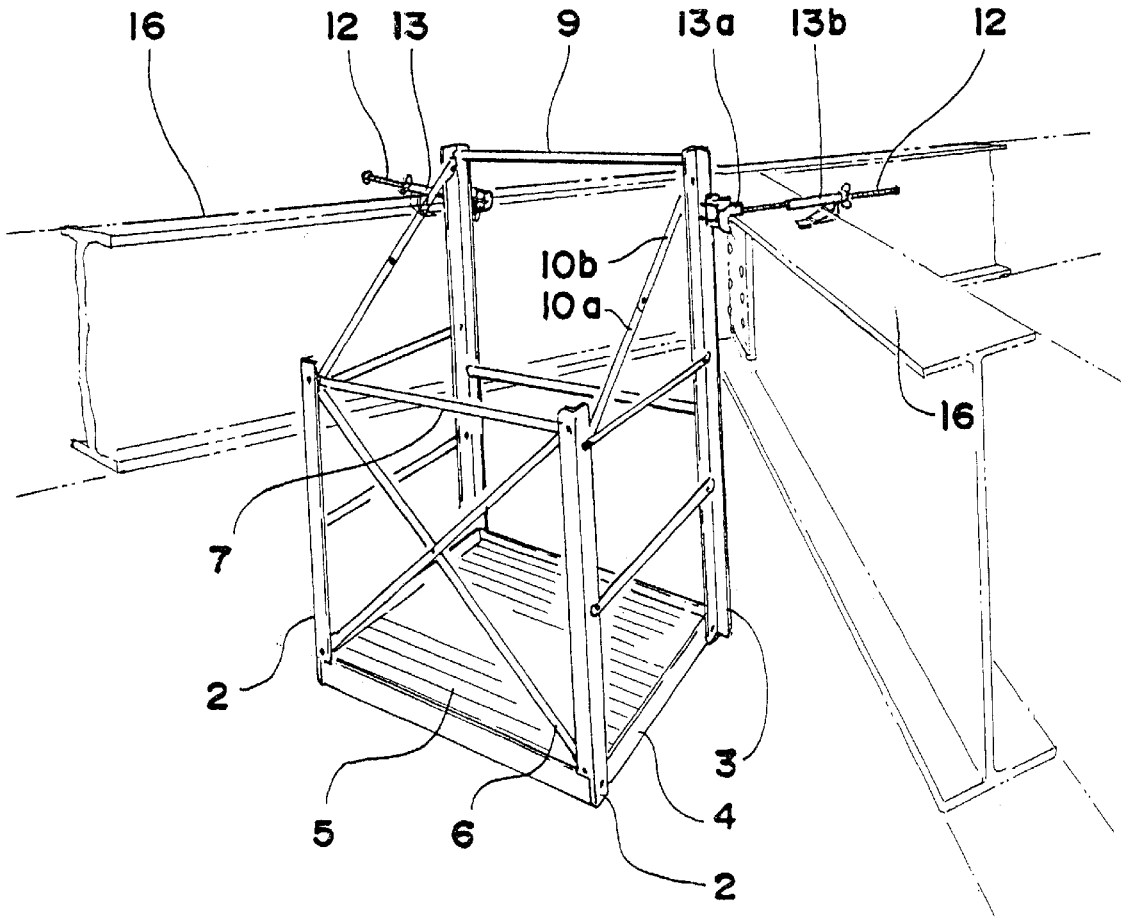
FIG. 7 is a perspective view attached a fit-up portion of a scaffold device to a H-sectional steel according to another embodiment of the present invention.

In accordance with the invention there is provided an erectable and transportable scaffold cage which comprises a rear frame structure made up of elongated side struts 3, 3 which are interconnected by a plurality of horizontal transversely extending brace beam 9. A front frame structure comprising side angled members 2, 2 which are shorter than the rear angled 3, 3 and one or more cross members 7 and diagonal bracing 6 is hinged to the rear structure through a plurality of parallel lateral bracing members or supports 8 which are articulated at their respective ends to the respective front and rear structures. The front structure may be folded into juxtaposition with the rear structure as shown in FIG. 5 or it may be erected to the position in FIG. 1 in which the reinforcing plate 1 extends substantially horizontally. The reinforcing plate 1 is provided with a plurality of bolt portions which are pivotally connected to the respective struts 2, 2 and 3,3 at their lower ends. The scaffold plate 5 inserted over the reinforcing plate 1 includes upstanding side edges 4 which engage within the angled remembers 2, 2 in the erected position but do not hinder the folding the structure.

The upper ends of each of these front frame sides 2, 2 are connected to the upper ends of the rear struts 3, 3 by connecting elements such as link plates 10*a*, 10*b*. A holding bracket 11 is fixed to the rear struts 3, 3 by rivets 11*a* and spacers 11*b*. It is explained minutely about a jointing or fastening portion of a holding bracket 11 referring FIG. 2 hereinafter.

The front pawl 13*a* is rotatably supported to a holding bracket 11 through a guide member 14 by a bolt 11*c* and a nut 11*d*. A bolt 12 is inserted into a guide member 14 placing a rear pawl 13*b* from rearward and fixed by a bolt 14*a*. The rear pawl 13*b* is loosely supported on a bolt 12 which is threaded by a nut 15 with a handle from rearward. A spacer 18*a* is tightened on end of a bolt 12 by a thread 18*b* to prevent a drop of a nut 15.

Figure 3:
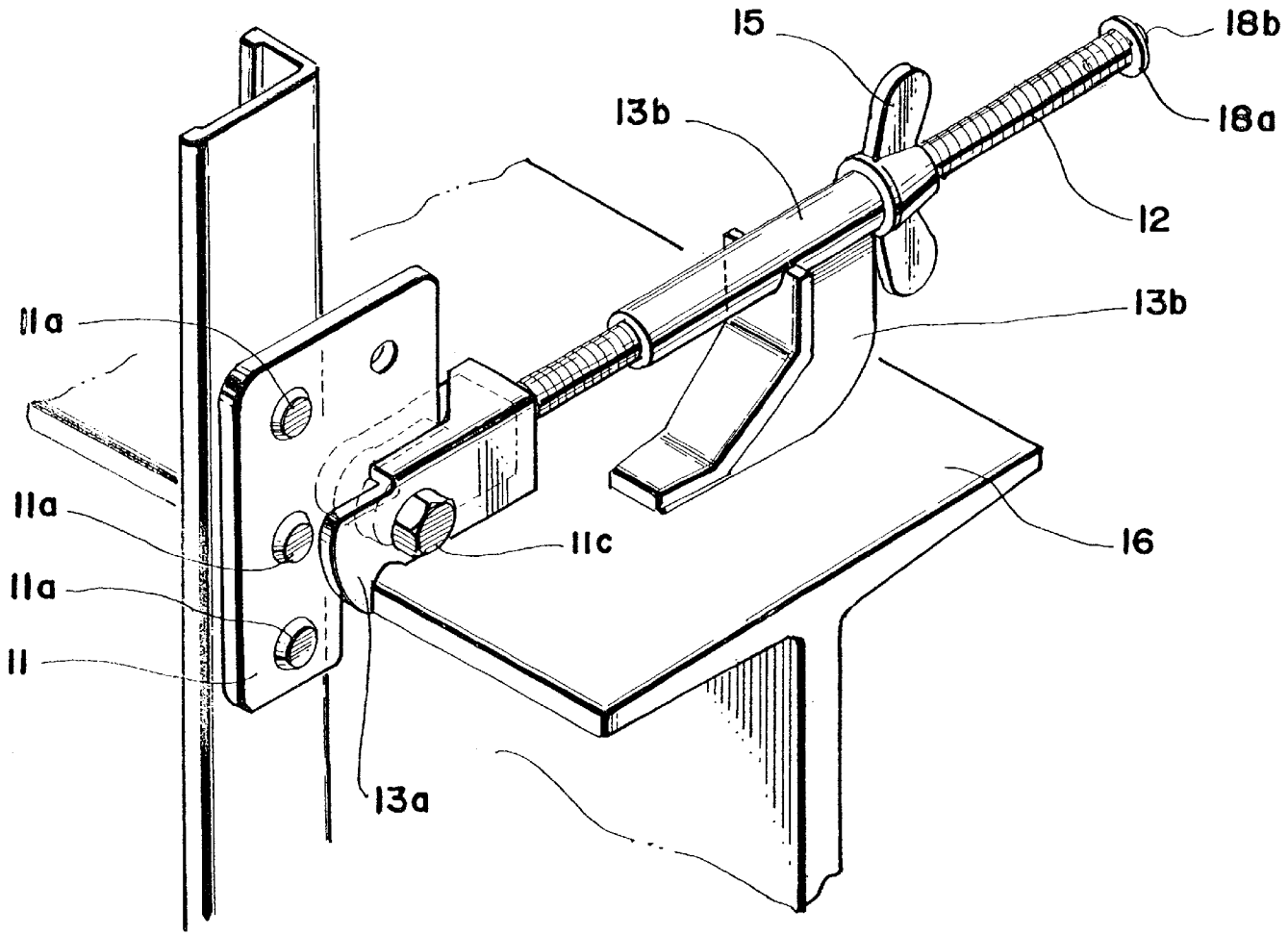
FIG. 3 is a perspective view attached a fit-up portion of a scaffold device according to an embodiment of the present invention.
Figure 4:
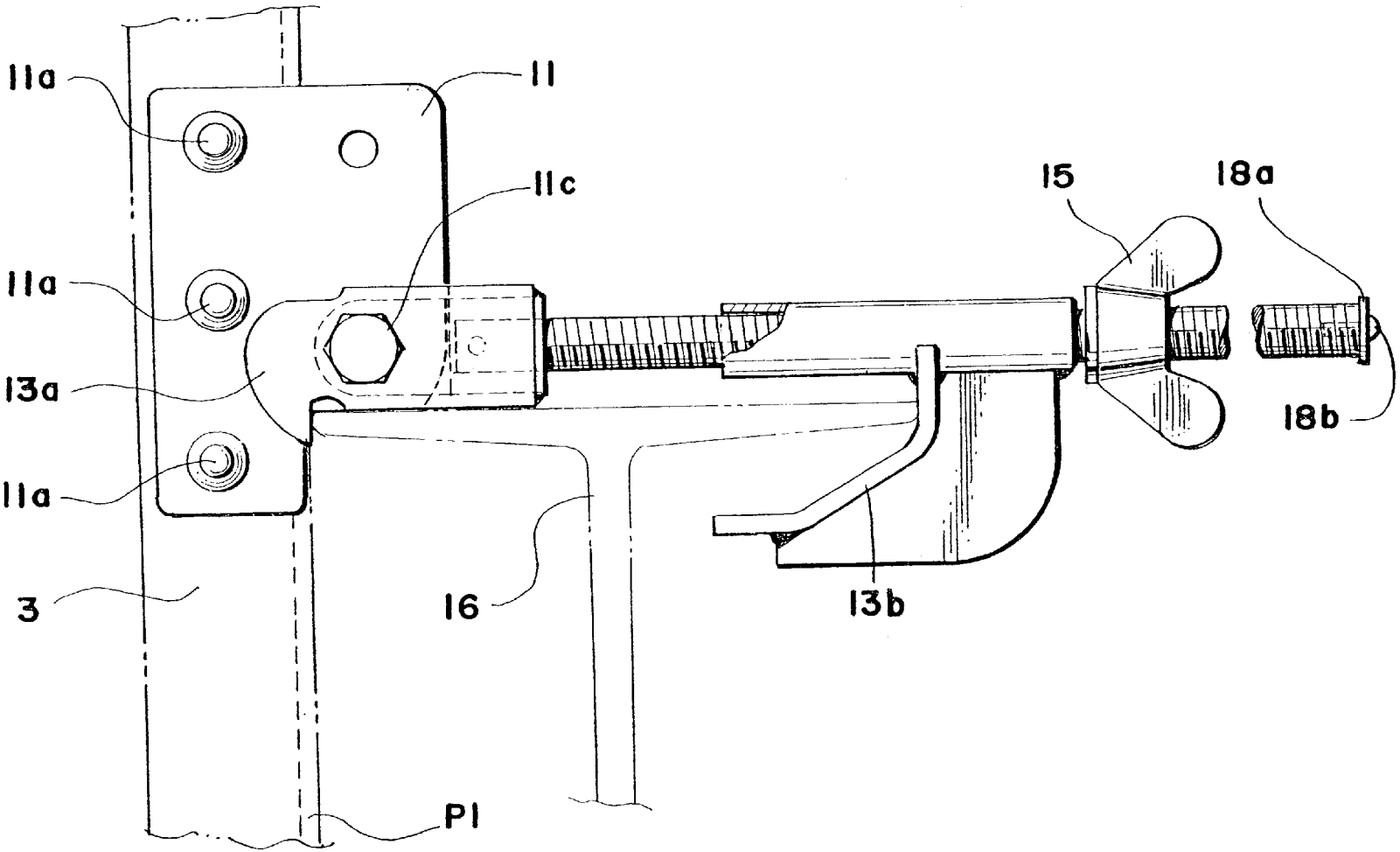
FIG. 4 is a side view of an essential part of a fit-up portion of a scaffold device according to an embodiment of the present invention.

As shown in FIGS. 3, 4, the front pawl 13*a* and the rear pawl 13*b* contain means for supporting the structure part on a support structure such as an I-beam 16 and are fitted to a holding bracket 11 to which is pivotally connecting a bolt member 12 and which is rigid throughout and/or consists of a single unitary structure. The bolt member 12 having the front pawl 13*a* and the rear pawl 13*b* is fitted up to the holding bracket 11 which is rigidly fixed on rear struts in such a way that a surface fitting thereto is parallel and still to a surface connecting the bolt member. The rear pawl 13*b* having a cylindrical portion is engaged over the bolt member 12 and the rear pawl may be urged against the underside of an I-beam top flange by tightening a nut 15 which is engageable on the threads of the bolt 12.

Angle bars form short front struts 2 and long rear struts 3. The lower ends of the short struts 2 and the long struts 3 are rotatably supported on pivot pin la carried on respective corners on substantially a scaffold plate 5. A scaffold plate 5 has an upright skirt 4 extending around its periphery and is supported thereby and by bolts la in four corners.

An X-shaped bracing on beam 6 and a horizontal plate 7 are rotatably supported at their ends respective opposite ends of the front struts 2 so as to form both a reinforcement and a handrail. Front struts 2 and rear struts 3 are rotatably connected with one another through a plurality of horizontal plate 8 and 9 which are also handrails.

Link plates 10*a*, 10*b* are connected at one end to the upper end of each front strut 2 and at the other end to the upper end of each rear strut 3. When the link plates 10*a*, 10*b* are stretched due to their own weights, the scaffold plate 5 and front struts 2 may move forward to form a gondola or cage as in FIG. 1. The link plates 10*a*, 10*b* may be pulled toward the rear struts 3 to collapse the cage and to cause the scaffold plate 5 and others to be folded upwardly.

The link plates 10*a*, 10*b* may be replaced with an extensible, chain or so. Further, a bolt 12 extending rearward through a fitting 11 is fixed to each rear strut 3 through a guide member 14 and has a beam holder 13 removably and loosely fitted to it. This holder 13 consists of a tube in which the bolt 12 is to be inserted, and has a hook-shaped jaw or pawls 13*a*, 13*b* connected to the tube and extending inwardly. Further, a nut 15 to be moved by the rotating operation of a handle portion is thread onto the bolt 12. When the nut 15 is moved toward the gondola, it pushes the pawl 13*b* toward a tip surface Q of the pawl 13*a* into engagement with the beam 16. Said tip surface Q is positioned backward behind an end surface P of a fitting plate 11 as shown in FIG. 2.

Figure 2:
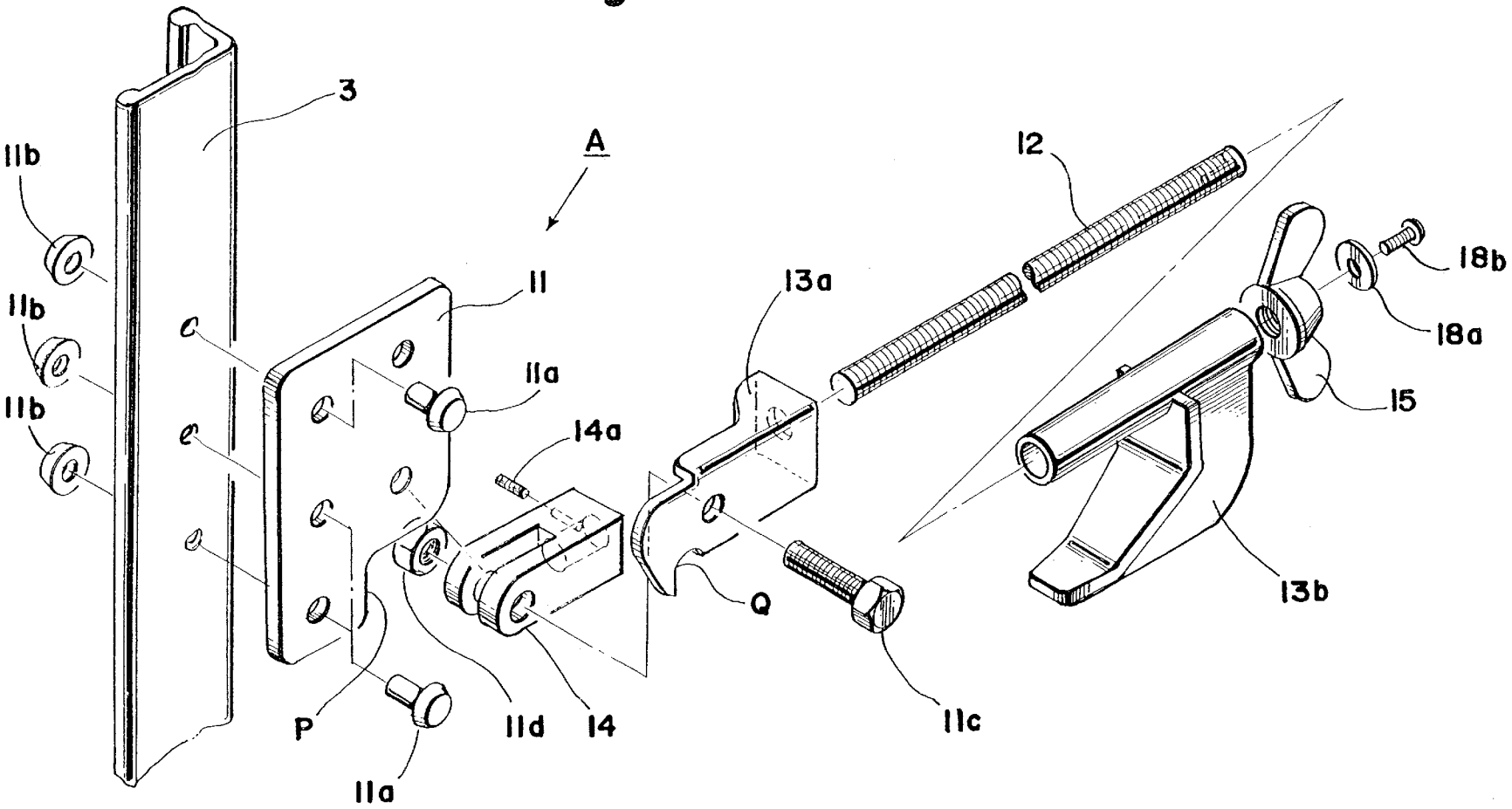
FIG. 2 is a perspective view of a fit-up portion of a scaffold device to a H-sectional steel according to an embodiment of the present invention.

Now, a bolt 12 extending rearward can be directly fixed to each rear strut 3 and on that occasion said tip surface Q is positioned backward behind an end surface P1 of a rear structure 3 in FIG. 2.

The operation of the scaffold device of the present invention shall be explained in the following.

When the tip surface Q of the front pawl 13*a* is pressed against the end of the H-sectioned steel beam 16 for example in a position for facilitating work by the occupant of the cage, for example, on the side of the ship for shipbuilding, the nut 15 is rotated to push in rear pawl 13*b* toward the H-sectioned steel beam 16 so that the teeth at the tip may engage the top plate, the cage becomes to be fixed to the H-sectioned steel beam 16. When the scaffold to be removed from the steel beam 16, the nut 15 may be reversely rotated to loosen the pawls 13*a*. 13*b*.

When the work in the working position is finished, the gondola-like scaffold can be freely carried to another position as in a folded sate and opened by loosening the link plates 10*a*, 10*b*.

In case the scaffold device is to be housed, if the link plates 10*a*, 10*b* are pulled to the back, the front struts will be pulled upward. And as scaffold plate 5 and beam 6 and 8 connected to these struts 2 are all rotatably borne, these members will be folded in parallel with the rear struts 3 as shown in FIG. 5.

As the scaffold device of the present invention can be so compactly folded as to require a small housing space and to be simple to carry, and simple to fit it into and remove from a working place.

In case the scaffold device of the present invention is to be used, the scaffold device is fixed and settled safely, reliably and firmly to the I-beam 16 as the guide member 14 and the hinge 17 freely rotate to any directions.

According to the present invention, its provided an erectable and transportable scaffold cage which is not inclined even when it may be engaged with a strong force against a support structure such as an I-beam by threading a wing nut.

And further, it is provided an erectable and transportable scaffold cage which is fixed and settable safely, reliably and firmly to a support structure in a space to construct in any conditions. The scaffold device has an enough freedom to fit for any beams placed in any kinds of conditions.

While a specific embodiment of the invention has been shown and described in detail to illustrate the application of the principles of the invention, it will be understood that the invention may be embodied otherwise without departing from such principles.

What I claim is:

1. An erectable and transportable scaffold device adapted to be engaged upon and supported on a support beam, the scaffold device comprising a rear frame structure, securing means on said rear frame structure for securing said rear frame structure to the support beam, a front frame structure shorter than said rear frame structure, a plurality of lateral braces arranged in vertically spaced parallel relationship and pivotally connected at their respective ends to the respective said rear frame structure and said front frame structure, a scaffold plate forming a scaffold floor pivotally connected to each side of said rear frame structure and said front frame structure adjacent the bottom ends thereof a link member connected between the tops of corresponding respective ends of said rear and front frame structures and supporting said front frame structure in an erected position spaced outwardly from said rear frame structure and also in a collapsed position with said front frame juxtaposed, in respect to said rear frame, in an erected position, said front and rear frame structures and said side braces defining a cage therewithin, and said securing means including a holding bracket consisting of a single unitary structure and being connected rigid throughout to said rear frame structure, and having front pawl parallel to and supported rotatably with respect to said holding bracket through a guide member connected to a bolt and a rear pawl slidably positioned along said bolt, said rear pawl being engaged against the support beam by threading a wing nut onto said bolt behind said rear pawl to lock said rear pawl in position, and wherein said rear frame structure carries in parallel and rigidly said holding bracket.

2. The erectable and transportable scaffold device according to claim 1, wherein said bolt having said front pawl and said rear pawl is fitted up to said guide member.

3. The erectable and transportable scaffold device according to claim 1, wherein said front pawl has a support beam contact He is rearward of the holding bracket and rear frame.

4. The erectable and transportable scaffold device according to claim 1, wherein a tip surface of said front pawl is positioned rearwardly of a rear end surface of said holding bracket.

5. The erectable and transportable scaffold device according to claim 1, wherein said rear frame structure carries rigidly said holding bracket such in a status that a surface fitting to said rear frame structure is parallel and in a fixed position with respect to a surface connecting said bolt.

6. A scaffold device comprising:

a first frame;

a plurality of lateral braces pivotally connected to said first frame;

a second frame pivotally connected to said plurality of braces, said first and second frames being connected to said plurality of lateral braces to move said second frame between collapsed and expanded positions relative to said first frame, said second frames being positioned adjacent said first frame in said collapsed position, said second frame being positioned spaced said first frame in said expanded position and de a cage with said first frame;

a fastening portion connected to said first frame, said portion including first and second pawls, connectable around a beam, a holding bracket, a guide member, a bolt and a wing nut, said first pawl being rotationally connected to said first frame about one axis through said holding bracket, said holding bracket consisting of a single unitary structure rigidly fixed to said fist frame and fixing said first pawl about all other rotational axes via said guide member said guide member being connected to said bolt, said second pawl slidably being positioned along said bolt, said rear pawl being engageable against the beam by threading said wing nut onto said bolt behind said second pawl to lock said second paw in a position, and wherein said rear frame structure carries in parallel and rigidly said holding bracket.

7. The device in accordance with claim 6, wherein:

the beam has longitudinal a said first pawl being rotationally connected to said fir frame about the longitudinal axis of the be said first pawl being rigidly fixed to sad first frame in all other rotational directions via said guide member.

8. The device in accordance with claim 6, wherein:

said first pawl has a contact surface contactable with the beam said contact surface being spaced from said first frame.

9. The device in accordance with claim 8, wherein:

said contact surface is closer to said second pawl than said first frame.

10. The device in accordance with claim 6, wherein:

said first pawl has a contact surface contactable with the beam, said contact surface being spaced from said first frame in a direction of said second pawl.

* * * * *